US005358136A

United States Patent [19]

Rubendall

[11] Patent Number: 5,358,136

[45] Date of Patent: Oct. 25, 1994

[54] RESEALABLE LIQUID CONTAINER

[76] Inventor: Robert J. Rubendall, 64-36 68th Ave., Apt. 2-L, Glendale, N.Y. 11385

[21] Appl. No.: 144,409

[22] Filed: Nov. 2, 1993

Related U.S. Application Data

[62] Division of Ser. No. 24,741, Mar. 2, 1993.

[51] Int. Cl.[5] ..... B65D 43/20

[52] U.S. Cl. ..... 220/346; 220/254; 220/345; 220/350; 222/153; 222/561

[58] Field of Search ..... 220/254, 345, 346, 347, 220/350, 714, 715; 222/153, 559, 561

[56] References Cited

U.S. PATENT DOCUMENTS 3,363,798 1/1968 Garangiotis ..... 220/345 X

*Primary Examiner*—Allan N. Shoap
*Assistant Examiner*—Nova Stucker
*Attorney, Agent, or Firm*—Richard L. Miller

[57] ABSTRACT

A resealable liquid container is provided which consists of a cylindrical body to hold liquid therein. A top end is affixed on the cylindrical body, with the top end having an aperture therein. A structure is built-in the top end of the aperture, for opening and reclosing the aperture. When the aperture is opened the liquid can be poured therefrom. When the aperture is closed the liquid will be retained therein, so that the liquid can be maintained in a sanitary condition.

1 Claim, 1 Drawing Sheet

RESEALABLE LIQUID CONTAINER

CROSS-REFERENCE

This is a divisional application of Ser. No.: 08/024,741 filed on Mar. 2, 1993.

BACKGROUND OF THE INVENTION

The instant invention relates generally to beverage cans and more specifically it relates to a resealable liquid container.

Numerous beverage cans have been provided in the prior art that are constructed to be self-opening and then capable of being selectably reclosed once the cans are opened. For example, U.S. Pat. No. 3,880,319 to Wells et al.; 4,561,560 to Lyon and 4,821,912 to Wells all are illustrative of such prior art. While these units may be suitable for the particular purpose to which they address, they would not be as suitable for the purpose of the present invention as hereafter described.

SUMMARY OF THE INVENTION

A primary object of the present invention is to provide a resealable liquid container that will overcome the shortcomings of the prior art devices.

Another object is to provide a resealable liquid container with a built-in closure member which can open and reclose on a top end of the container, so that it can be stored for later consumption.

An additional object is to provide a resealable liquid container in which the built-in closure member will keep the pour area on the top end of the container sanitary as well as the liquid contained therein after it has been reclosed.

A further object is to provide a resealable liquid container that is simple and easy to use.

A still further object is to provide a resealable liquid container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 5:
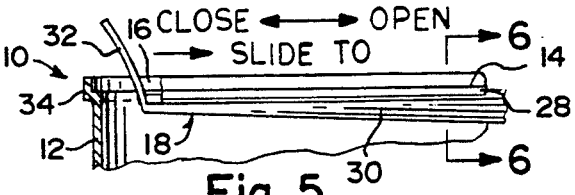
FIG. 5 is an enlarged diagrammatic cross sectional view taken along line 5—5 in FIG. 4.
Figure 5A:
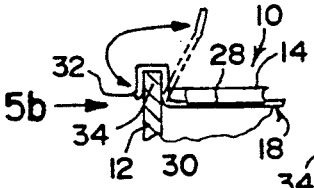
Figure 5B:
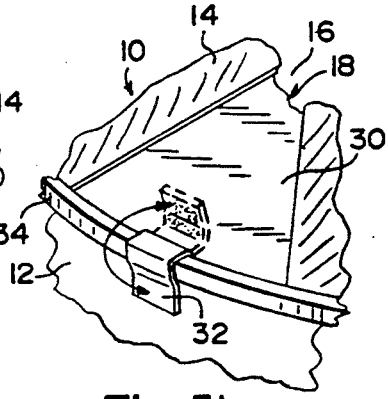

FIG. 5*a* is an enlarged diagrammatic cross sectional view similar to FIG. 5, with parts broken away showing the closure member closed;

FIG. 5*b* is an enlarged diagrammatic perspective view with parts broken away taken generally in the direction of arrow 5*b* in FIG. 5*a;*

Figure 4:
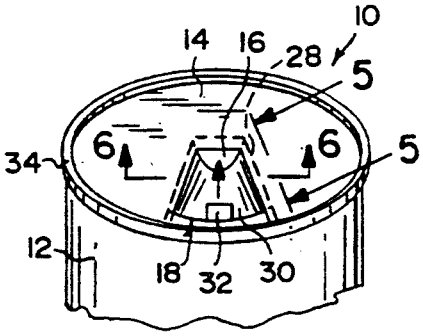
FIG. 4 is a diagrammatic perspective view of a second embodiment of the instant invention showing the closure member in the container partially opened.
Figure 7:
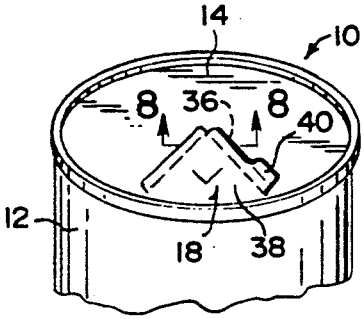
Figure 6:
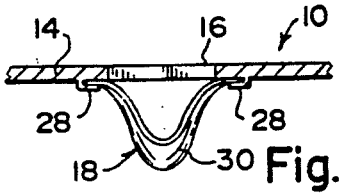
Figure 9:
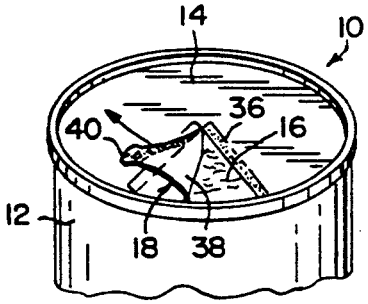
Figure 8:
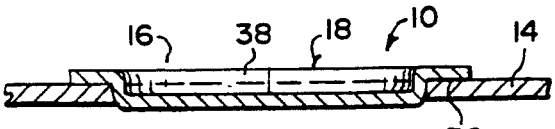

FIG. 6 is a diagrammatic cross sectional view taken along line 6—6 in FIGS. 4 and 5;

FIG. 7 is a diagrammatic perspective view of a third embodiment of the instant invention showing the closure member in the container closed;

FIG. 8 is an enlarged cross sectional view taken along line 8—8 in FIG. 7; and FIG. 9 is a diagrammatic perspective view similar to FIG. 7 showing the closure member partially opened.

DETAILED DESCRIPTION OF THE PREFERRED EMVODIMENTS

Turning now descriptively to the drawings, in which similar reference characters denote similar elements throughout the several views, FIGS. 1 through 8 illustrate a resealable liquid container 10 which consists of a cylindrical body 12 to hold liquid therein. A top end 14 is affixed on the cylindrical body 12 with the top end 14 having an aperture 16 therein. A structure 18 is built-in the top end 14 at the aperture 16, for opening and reclosing the aperture 16. When the aperture 16 is opened the liquid can be poured therefrom. When the aperture 16 is closed the liquid will be retained therein, so that the liquid can be maintained in a relatively clean and sanitary condition.

Figure 1:
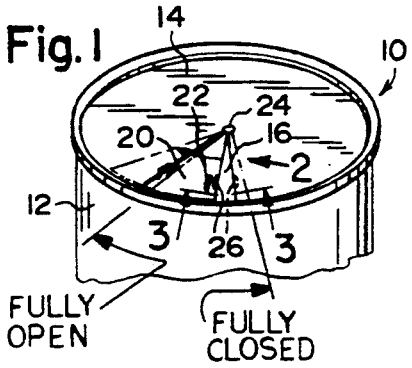
FIG. 1 is a diagrammatic perspective view of a first embodiment of the instant invention showing the closure member in the container partially open.
Figure 2:
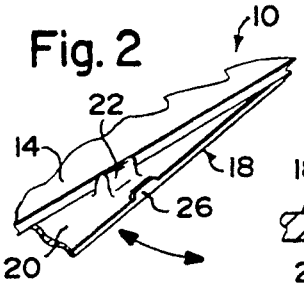
FIG. 2 is an enlarged diagrammatic perspective view with parts broken away taken in the direction of arrow 2 in FIG. 1, showing the closure member fully opened.
Figure 3:
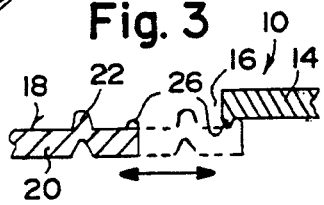
FIG. 3 is an enlarged diagrammatic cross sectional view taken along line 3—3 in FIG. 1.

In a first embodiment the opening and reclosing structure 18, as shown in FIGS. 1 through 3, includes a closure member 20 having an upwardly extending finger grip 22 thereon. A rivet 24 is mounted into the top end 14 and the closure member 20 under the aperture 16, so as to allow the closure member 20 to pivot about the rivet 24 between a fully opened position and a fully closed position with respect to the aperture 16. A snap lock 26 is formed between an upper forward side edge of the closure member 20 and a matching lower side edge of the top end 14 within the aperture 16, so as to retain the closure member 20 when in the fully closed position.

In second embodiment the opening and reclosing structure 18, as shown in FIGS. 4 through 6, contains a pair of tracks 28, each formed on a bottom surface of the top end 14 adjacent opposite side edges of the aperture 16. A closure member 30 fits into the pair of tracks 28, so as to slide between a fully opened position and a fully closed position with respect to the aperture 16. A flange seal 32 is formed from a bondable tab onto a front edge of the closure member 30. The flange seal 32 can be mechanically bent, as illustrated in FIGS. 5 and 5*a*, so as to engage with a portion of the rim 34 of the top end 14 adjacent the aperture 16, when the closure member 30 is in the fully closed position to retain the closure member 30 thereto. The flange seal 32 can then disengage with the portion of the rim 34 of the top end 14, to allow the closure member 30 to slide into the fully opened position. In order for the closure member 30 to open in this embodiment it must buckle inwardly somewhat as best seen in FIG. 6 as it is positioned toward the center of the container, because the tracks are closer together at the center of the container then at an outer edge of the container as illustrated in FIGS. 4 and 5*b*.

In the third embodiment the opening and reclosing structure 18, as shown in FIGS. 7 through 9, consists of adhesive material 36 applied onto a top surface of the top end 14 adjacent the side edges of the aperture 16. A closure member 38 is sized to fit over the aperture 16 and onto the adhesive material 36. A flap 40 is formed onto one edge of the closure member 38. When the flap 40 is pulled upwardly a portion of the closure member 38 will be lifted away from the adhesive material to an opened position. When the closure member 38 is pressed down it will return back to a closed position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A resealable liquid container which comprises:

a) a cylindrical body to hold liquid therein;

b) a top end affixed on said cylindrical body, with said top end having an aperture therein; and c) means built-in said top end at said aperture, for opening and reclosing said aperture, so that when said aperture is opened said liquid can be poured therefrom and when said aperture is closed said liquid will be retained therein, so that said liquid can be maintained in a sanitary condition, wherein said opening and reclosing means includes:

i) a pair of tracks, each formed on a bottom surface of said top end adjacent opposite side edges of said aperture which are closer together at a center of said container then at an outer edge of said container;

ii) a closure member to fit into said pair of tracks, so as to slide between a fully opened position and a fully closed position with respect to said aperture and which must buckle inwardly as it is positioned toward a center of said said container; and iii) a flange seal formed from a bendable tab onto a front edge of said closure member, so that said flange seal can be mechanically bent so as to engage with a portion of a rim of said top end adjacent said aperture when said closure member is in said fully closed position to retain said closure member thereto and then disengage with the portion of the rim of said top end to allow said closure member to go into said fully opened position.

* * * * *